US008491731B2

(12) United States Patent
Makino

(10) Patent No.: US 8,491,731 B2
(45) Date of Patent: Jul. 23, 2013

(54) ALLOY COMPOSITION, FE-BASED NANO-CRYSTALLINE ALLOY AND FORMING METHOD OF THE SAME AND MAGNETIC COMPONENT

(76) Inventor: Akihiro Makino, Sendai (JP)

( * ) Notice: Subject to any disclaimer, the term of this patent is extended or adjusted under 35 U.S.C. 154(b) by 259 days.

(21) Appl. No.: 12/544,506

(22) Filed: Aug. 20, 2009

(65) Prior Publication Data

US 2010/0043927 A1 Feb. 25, 2010

(30) Foreign Application Priority Data

Aug. 22, 2008 (JP) ..... 2008-214237

(51) Int. Cl.
*H01F 1/00* (2006.01)
*C22C 38/02* (2006.01)
*C22C 38/16* (2006.01)

(52) U.S. Cl.
USPC ..... 148/307; 148/121; 148/305; 420/87; 420/89; 420/99; 420/117

(58) Field of Classification Search
USPC ..... 148/304–307; 420/89–91, 99–100, 420/103–104, 117
See application file for complete search history.

(56) References Cited

U.S. PATENT DOCUMENTS 4,881,989 A 11/1989 Yoshizawa et al.
5,160,379 A 11/1992 Yoshizawa et al.
5,961,745 A 10/1999 Inoue et al.
6,425,960 B1 7/2002 Yoshizawa et al.
2009/0266448 A1 * 10/2009 Ohta et al. ..... 148/121
2010/0097171 A1 4/2010 Urata et al.
2010/0139814 A1 6/2010 Makino

FOREIGN PATENT DOCUMENTS

EP 1 925 686 A1 * 5/2008
JP 63-302504 12/1988
JP 2573606 A 12/1988
JP 4-229604 8/1992
JP 2812574 A 8/1992
JP 5-263197 A 10/1993
JP 7-11396 A 1/1995
JP 9-320827 A 12/1997
JP 11-071647 A 3/1999
JP 2004-2949 A 1/2004
JP 2004-349585 A 12/2004
JP 2005-60805 A 3/2005
JP 2005-290468 A 10/2005
JP 2006-40906 A 2/2006

(Continued)

OTHER PUBLICATIONS

International Search Report dated Nov. 17, 2009, issued in the counterpart International Application No. PCT/JP2009/003951. 2 sheets.

(Continued)

*Primary Examiner* — Roy King
*Assistant Examiner* — Timothy Haug
(74) *Attorney, Agent, or Firm* — Holtz Holtz Goodman & Chick PC

(57) ABSTRACT

An alloy composition of $Fe_aB_bSi_cP_xC_yCu_z$. Parameters meet the following conditions: 79≦a≦86 atomic %; 5≦b≦13 atomic %; 0≦c≦8 atomic %; 1≦x≦8 atomic %; 0≦y≦5 atomic %, 0.4≦z≦1.4 atomic %; and 0.08≦z/x≦0.8. Or, parameters meet the following conditions: 81≦a≦86 atomic %; 6≦b≦10 atomic %; 2≦c≦8 atomic %; 2≦x≦5 atomic %; 0≦y≦4 atomic %; 0.4≦z≦1.4 atomic %, and 0.08≦z/x≦0.8.

17 Claims, 2 Drawing Sheets

FOREIGN PATENT DOCUMENTS

| | | | |
|---|---|---|---|
| JP | 2007-107095 | A | 4/2007 |
| JP | 2007-270271 | A | 10/2007 |
| WO | WO 02/077300 | A1 | 10/2002 |
| WO | WO 2007/032531 | A1 | 3/2007 |
| WO | WO 2008/068899 | A1 | 6/2008 |
| WO | WO 2008/129803 | A1 | 10/2008 |

OTHER PUBLICATIONS

Shen. Baolong et al., "Formation, ductile deformation behavior and soft-magnetic properties of (Fe, Co, Ni)—B—Si—Nb bulk glassy alloys," Intermetallics 15, (2007), pp. 9-16.

Y. Yoshizawa et al., "Fe Based Soft Magnetic Alloys Composed of Ultrafine Grain Structure," J. Japan Inst. Metals, vol. 53, No. 2 (Feb. 1989). pp. 241-248.

K. Yamauchi et al., "Iron Based Nanocrystalline Soft Magnetic Materials," Journal of Magnetics Society of Japan, vol. 14, No. 5, pp. 684-688.

K. Suzuki et al., "Low core losses of nanocrystalline Fe—M—B (M=Zr, Hf, or Nb) alloys," J. Appl. Phys. 74 (5), Sep. 1, 1993, 0021-8979/93/74(5), pp. 3316-3321.

H. Watanabe et al., "Soft Magnetic Properties and Structures of Nanocrystalline Fe—A1—Si—Nb—B Alloy Ribbons," Journal of Magnetics Society of Japan, vol. 17, No. 2, p. 191-196, (1993).

* cited by examiner

ALLOY COMPOSITION, FE-BASED NANO-CRYSTALLINE ALLOY AND FORMING METHOD OF THE SAME AND MAGNETIC COMPONENT

CROSS REFERENCE TO RELATED APPLICATIONS

An Applicant claims priority under 35 U.S.C. §119 of Japanese Patent Application No. JP2008-214237 filed Aug. 22, 2008.

BACKGROUND OF THE INVENTION

This invention relates to an Fe-based nano-crystalline alloy and a forming method thereof, wherein the Fe-based nano-crystalline alloy is suitable for use in a transformer, an inductor, a magnetic core included in a motor, or the like.

Use of nonmetallic elements such as Nb for obtaining a nano-crystalline alloy causes a problem that saturation magnetic flux density of the nano-crystalline alloy is lowered. Increase of Fe content and decrease of nonmetallic elements such as Nb ca provide increased saturation magnetic flux density of the nano-crystalline alloy but causes another problem that crystalline particles becomes rough. JP-A 2007-270271 discloses an Fe-based nano-crystalline alloy which can solve the above-mentioned problems.

However, the Fe-based nano-crystalline alloy of JP-A 2007-270271 has large magnetostriction of $14\times10^{-6}$ and low magnetic permeability. In addition, because large amount of crystal is crystallized while being rapidly cooled, the Fe-based nano-crystalline alloy of JP-A 2007-270271 has poor toughness.

SUMMARY OF THE INVENTION

It is therefore an object of the present invention to provide an Fe-based nano-crystalline alloy, which has high saturation magnetic flux density and high magnetic permeability, and a method of forming the Fe-based nano-crystalline alloy.

As a result of diligent study, the present inventor has found that a specific alloy composition can be used as a starting material for obtaining an Fe-based nano-crystalline alloy which has high saturation magnetic flux density and high magnetic permeability, wherein the specific alloy composition is represented by a predetermined composition and has an amorphous phase as a main phase and superior toughness. The specific alloy is exposed to a heat treatment so that nanocrystals consisting of bccFe phase can be crystallized. The nanocrystals can remarkably degrease saturation magnetostriction of the Fe-based nano-crystalline alloy. The degreased saturation magnetostriction can provide higher saturation magnetic flux density and higher magnetic permeability. Thus, the specific alloy composition is a useful material as a starting material for obtaining the Fe-based nano-crystalline alloy which has high saturation magnetic flux density and high magnetic permeability.

One aspect of the present invention provides, as a useful starting material for an Fe-based nano-crystalline alloy, an alloy composition of $Fe_aB_bSi_cP_xC_yCu_z$, where $79\leqq a\leqq86$ atomic %, $5\leqq b\leqq13$ atomic %, $0\leqq c\leqq8$ atomic %, $1\leqq x\leqq8$ atomic %, $0\leqq y\leqq5$ atomic % $0.4\leqq z\leqq1.4$ atomic %, and $0.08\leqq z/x\leqq0.8$.

Another aspect of the present invention provides, as a useful starting material for an Fe-based nano-crystalline alloy, an alloy composition of $Fe_aB_bSi_cP_xC_yCu_z$, where $81\leqq a\leqq86$ atomic %, $6\leqq b\leqq10$ atomic %, $2\leqq c\leqq8$ atomic %, $2\leqq x\leqq5$ atomic %, $0\leqq y\leqq4$ atomic %, $0.4\leqq z\leqq1.4$ atomic %, and $0.08\leqq z/x\leqq0.8$.

The Fe-based nano-crystalline alloy, which is formed by using one of the aforementioned alloy compositions as a starting material, has low saturation magnetostriction so as to have higher saturation magnetic flux density and higher magnetic permeability.

An appreciation of the objectives of the present invention and a more complete understanding of its structure may be had by studying the following description of the preferred embodiment and by referring to the accompanying drawings.

Figure 1:
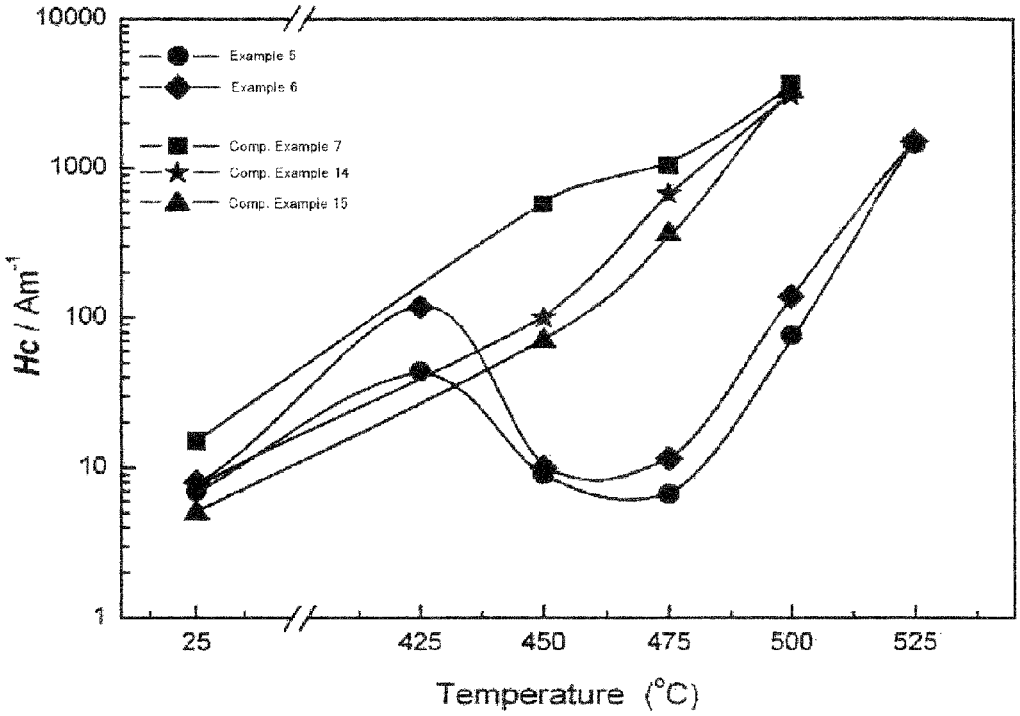
FIG. 1 is a view showing relations between coercivity Hc and heat-treatment temperature for examples of the present invention and comparative examples.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

An alloy composition according to an embodiment of the present invention is suitable for a starting material of an Fe-based nano-crystalline alloy and is of $Fe_aB_bSi_cP_xC_yCu_z$, where $79\leqq a\leqq86$ atomic %, $5\leqq b\leqq13$ atomic %, $0\leqq c\leqq8$ atomic %, $1\leqq x\leqq8$ atomic %, $0\leqq y\leqq5$ atomic %, $0.4\leqq z\leqq1.4$ atomic %, and $0.08\leqq z/x\leqq0.8$. It is preferable that the following conditions are met for b, c, and x: $6\leqq b\leqq10$ atomic %; $2\leqq c\leqq8$ atomic %; and $2\leqq x\leqq5$ atomic %. It is preferable that the following conditions are met for y, z, and z/x: $0\leqq y\leqq3$ atomic %, $0.4\leqq z\leqq1.1$ atomic %, and $0.08\leqq z/x\leqq0.55$. Fe may be replaced with at least one element selected from the group consisting of Ti, Zr, Hf, Nb, Ta, Mo, W, Cr, Co, Ni, Al, Mn, Ag, Zn, Sn, As, Sb, Bi, Y, N, O and rare-earth elements at 3 atomic % or less.

In the above alloy composition, the Fe element is a principal component and an essential element to provide magnetism. It is basically preferable that the Fe content is high for increase of saturation magnetic flux density and for reduction of material costs. If the Fe content is less than 79 atomic %, desirable saturation magnetic flux density cannot be obtained. If the Fe content is more than 86, it becomes difficult to form the amorphous phase under a rapid cooling condition so that crystalline particle diameters have various sizes or becomes rough. In other words, homogeneous nano-crystalline structures cannot be obtained so that the alloy composition has degraded soft magnetic properties. Accordingly, it is desirable that the Fe content is in a range of from 79 atomic % to 86 atomic %. In particular, if saturation magnetic flux density of 1.7 T or more is required, it is preferable that the Fe content is 81 atomic % or more.

In the above alloy composition, the B element is an essential element to form an amorphous phase. If the B content is less than 5 atomic %, it becomes difficult to form the amorphous phase under the rapid cooling condition. If the B content is more than 13 atomic %, ΔT is reduced, and homogeneous nano-crystalline structures cannot be obtained so that the alloy composition has degraded soft magnetic properties. Accordingly, it is desirable that the B content is in a range of from 5 atomic % to 13 atomic %. In particular, if the alloy composition is required to have its low melting point for mass-producing thereof, it is preferable that the B content is 10 atomic % or less.

In the above alloy composition, the Si element is an essential element to form an amorphous phase. The Si element contributes to stabilization of nanocrystals upon nano-crystallization. If the alloy composition does not include the Si element, the capability of forming an amorphous phase is lowered, and homogeneous nano-crystalline structures cannot be obtained so that the alloy composition has degraded soft magnetic properties. If the Si content is more than 8 atomic % or more, saturation magnetic flux density and the capability of forming an amorphous phase are lowered, and the alloy composition has degraded soft magnetic properties. Accordingly, it is desirable that the Si content is 8 atomic % or less (excluding zero). Especially, if the Si content is 2 atomic % or more, the capability of forming an amorphous phase is improved so as to stably form a continuous strip, and ΔT is increased so that homogeneous nanocrystals can be obtained.

In the above alloy composition, the P element is an essential element to form an amorphous phase. In this embodiment, a combination of the B element, the Si element and the P element is used to improve the capability of forming an amorphous phase and the stability of nanocrystals, in comparison with a case where only one of the B element, the Si element and the P element is used. If the P content is 1 atomic % or less, it becomes difficult to form the amorphous phase under the rapid cooling condition. If the P content is 8 atomic % or more, saturation magnetic flux density is lowered, and the alloy composition has degraded soft magnetic properties. Accordingly, it is desirable that the P content is in a range of from 1 atomic % to 8 atomic %. Especially, if the P content is in a range of from 2 atomic % to 5 atomic %, the capability of forming an amorphous phase is improved so as to stably form a continuous strip.

In the above alloy composition, the C element is an element to form an amorphous phase. In this embodiment, a combination of the B element, the Si element, the P element and the C element is used to improve the capability of forming an amorphous phase and the stability of nanocrystals, in comparison with a case where only one of the B element, the Si element, the P element and the C element is used. Because the C element is inexpensive, addition of the C element decreases the content of the other metalloids so that the total material cost is reduced. If the C content becomes 5 atomic % or more, the alloy composition becomes brittle, and the alloy composition has degraded soft magnetic properties. Accordingly, it is desirable that the C content is 4 atomic % or less. Especially, if the C content is 3 atomic % or less, various compositions due to partial evaporation of the C element upon fusion can be reduced.

In the above alloy composition, the Cu element is an essential element to contribute to nano-crystallization. It should be noted here that It is unknown before the present invention that the combination of the Cu element with the Si element, the B element and the P element or the combination of the Cu element with the Si element, the B element, the P element and the C element can contribute to nano-crystallization. Also, it should be noted here that the Cu element is basically expensive and, if the Fe content is 81 atomic % or more, causes the alloy composition to be easy to be brittle or be oxidized. If the Cu content is 0.4 atomic % or less, nano-crystallization becomes difficult. If the Cu content is 1.4 atomic % or more, a precursor of an amorphous phase becomes so heterogeneous that homogeneous nano-crystalline structures cannot be obtained upon the formation of the Fe-based nano-crystallization alloy, and the alloy composition has degraded soft magnetic properties. Accordingly, it is desirable that the Cu content is in a range of from 0.4 atomic % to 1.4 atomic %. In particular, it is preferable that the Cu content is 1.1 atomic % or less, in consideration of brittleness and oxidization of the alloy composition.

There is a large attraction force between P atom and Cu atom. Therefore, if the alloy composition includes a specific ratio of the P element and the Cu element, clusters are formed therein to have a size of 10 nm or smaller so that the nano-size clusters cause bccFe crystals to have microstructures upon the formation of the Fe-based nano-crystalline alloy. More specifically, the Fe-based nano-crystalline alloy according to the present embodiment includes bccFe crystals which have an average particle diameter of 25 nm or smaller. In this embodiment, the specific ratio (z/x) of the Cu content (z) to the P content (x) is in a range of from 0.08 to 0.8. If the ratio z/x is out of the range, homogeneous nano-crystalline structures cannot be obtained so that the alloy composition cannot have superior soft magnetic properties. It is preferable that the specific ratio (z/x) is in a range of from 0.08 to 0.55, in consideration of brittleness and oxidization of the alloy composition.

The alloy composition according to the present embodiment may have various shapes. For example, the alloy composition may have a continuous strip shape or may be formed in a powder form. The continuous strip shape of the alloy composition may be formed by using a conventional formation apparatus such as a single roll formation apparatus or a double roll formation apparatus, which are used to form an Fe-based amorphous strip or the like. The powder form of the alloy composition may be formed in a water atomization method or a gas atomization method or may be formed by crushing a strip of the alloy composition.

Especially, it is preferable that the alloy composition of the continuous strip shape is capable of being flat on itself when being subjected to a 180 degree bend test under a pre-heat-treatment condition, in consideration of a high toughness requirement. The 180 degree bend test is a test for evaluating toughness, wherein a sample is bent so that the angle of bend is 180 degree and the radius of bend is zero. As a result of the 180 degree bend test, a sample is flat on itself (O) or is broken (X). In an evaluation described afterwards, a strip sample of 3 cm length is bent at its center, and it is checked whether the strip sample is flat on itself (O) or is broken (X).

The alloy composition according to the present embodiment is molded to form a magnetic core such as a wound core, a laminated core or a dust core. The use of the thus-formed magnetic core can provide a component such as a transformer, an inductor, a motor or a generator.

The alloy composition according to the present embodiment has an amorphous phase as a main phase. Therefore, when the alloy composition is subjected to a heat treatment under an inert atmosphere such as an Ar-gas atmosphere, the alloy composition is crystallized at two times or more. A temperature at which first crystallization starts is defined as "first crystallization start temperature ($T_{x1}$)", and another temperature at which second crystallization starts is defined as "second crystallization start temperature ($T_{x2}$)". In addition, a temperature difference $\Delta T=T_{x2}-T_{x1}$ is between the first crystallization start temperature ($T_{x1}$) and the second crystallization start temperature ($T_{x2}$). Simple terms "crystallization start temperature" means the first crystallization start temperature ($T_{x1}$). These crystallization temperatures can be evaluated through a heat analysis which is carried out by using a differential scanning calorimetry (DSC) apparatus under the condition that a temperature increase rate is about 40° C. per minute.

The alloy composition according to the present embodiment is exposed to a heat treatment under the condition that a temperature increase rate is 100° C. or more per minute and the condition that a process temperature is not lower than the crystallization start temperature, i.e. the first crystallization start temperature, so that the Fe-based nano-crystalline alloy according to the present embodiment can be obtained. In order to obtain homogeneous nano-crystalline structures upon the formation of the Fe-based nano-crystallization alloy, it is preferable that the difference ΔT between the first crystallization start temperature ($T_{x1}$) and the second crystallization start temperature ($T_{x2}$) of the alloy composition is in a range of 100° C. to 200° C.

The thus-obtained Fe-based nano-crystalline alloy according to the present embodiment has high magnetic permeability of 10,000 or more and high saturation magnetic flux density of 1.65 T or more. Especially, selections of the P content (x), the Cu content (z) and the specific ratio (z/x) as well as heat treatment conditions can control the amount of nanocrystals so as to reduce its saturation magnetostriction. For prevention of deterioration of soft magnetic properties, it is desirable that its saturation magnetostriction is $10\times10^{-6}$ or less. Furthermore, in order to obtain high magnetic permeability of 20,000 or more, its saturation magnetostriction is $5\times10^{-6}$ or less.

By using the Fe-based nano-crystalline alloy according to the present embodiment, a magnetic core such as a wound core, a laminated core or a dust core can be formed. The use of the thus-formed magnetic core can provide a component such as a transformer, an inductor, a motor or a generator.

An embodiment of the present invention will be described below in further detail with reference to several examples.

Examples 1-46 and Comparative Examples 1-22

Materials were respectively weighed so as to provide alloy compositions of Examples 1-46 of the present invention and Comparative Examples 1-22 as listed in Tables 1 to 7 below and were arc melted. The melted alloy compositions were processed by the single-roll liquid quenching method under the atmosphere so as to produce continuous strips which have various thicknesses, a width of about 3 mm and a length of about 5 to 15 m. For each of the continuous strip of the alloy compositions, phase identification was carried out through the X-ray diffraction method. Their first crystallization start temperatures and their second crystallization start temperatures were evaluated by using a differential scanning calorimetory (DSC). In addition, the alloy compositions of Examples 1-46 and Comparative Examples 1-22 were exposed to heat treatment processes which were carried out under the heat treatment conditions listed in Tables 8 to 14. Saturation magnetic flux density Bs of each of the heat-treated alloy compositions was measured by using a vibrating-sample magnetometer (VMS) under a magnetic field of 800 kA/m. Coercivity Hc of each alloy composition was measured by using a direct current BH tracer under a magnetic field of 2 kA/m. Magnetic permeability μ was measured by using an impedance analyzer under conditions of 0.4 A/m and 1 kHz. The measurement results are shown in Tables 1 to 14.

TABLE 1

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Comparative Example 1 | $Fe_{81.7}B_6Si_9P_3Cu_{0.3}$ | Amo | 443 | 554 | 111 | 7.3 | 1.54 |
| Comparative Example 2 | $Fe_{82.7}B_7Si_6P_4Cu_{0.3}$ | Cry | 449 | 548 | 99 | 2.4 | |
| Comparative Example 3 | $Fe_{82.7}B_8Si_5P_4Cu_{0.3}$ | Amo | 486 | 548 | 62 | 2.2 | |
| Comparative Example 4 | $Fe_{82.7}B_9Si_4P_4Cu_{0.3}$ | Amo | 456 | 531 | 75 | 3.2 | |
| Comparative Example 5 | $Fe_{82.3}B_{12}Si_5Cu_{0.7}$ | Amo | 425 | 525 | 100 | 7 | |
| Comparative Example 6 | $Fe_{85}B_9Si_5$ | Cry | 385 | 551 | 166 | 160 | |
| Comparative Example 7 | $Fe_{84}B_{12}Si_4$ | Amo | 445 | 540 | 95 | 20 | |
| Comparative Example 8 | $Fe_{82}B_9Si_9$ | Cry | 395 | 547 | 152 | 100 | |

Amo: Amorphous; Cry: Crystal

TABLE 2

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Comparative Example 9 | $Fe_{78}Si_{6.3}B_{10}P_5Cu_{0.7}$ | Amo | 495 | 589 | 94 | 8.9 | 1.53 |
| Example 1 | $Fe_{79}Si_{5.3}B_{10}P_5Cu_{0.7}$ | Amo | 477 | 578 | 101 | 10.1 | 1.54 |
| Example 2 | $Fe_{80.3}B_{10}Si_5P_4Cu_{0.7}$ | Amo | 454 | 571 | 117 | 13.1 | 1.58 |
| Example 3 | $Fe_{81.3}B_7Si_8P_3Cu_{0.7}$ | Amo | 451 | 566 | 115 | 7.5 | 1.56 |

TABLE 2-continued

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Example 4 | $Fe_{82.3}B_7Si_7P_3Cu_{0.7}$ | Amo | 430 | 555 | 125 | 6 | 1.59 |
| Example 5 | $Fe_{83.3}B_8Si_4P_4Cu_{0.7}$ | Amo | 411 | 547 | 136 | 7.2 | 1.65 |
| Example 6 | $Fe_{84.3}B_8Si_4P_3Cu_{0.7}$ | Amo | 396 | 550 | 154 | 8.5 | 1.64 |
| Example 7 | $Fe_{85.3}B_{10}Si_2P_2Cu_{0.7}$ | Amo | 395 | 548 | 153 | 11 | 1.58 |
| Example 8 | $Fe_{85.3}B_8Si_2P_4Cu_{0.7}$ | Amo | 394 | 528 | 134 | 15 | 1.57 |
| Example 9 | $Fe_{85.0}B_{10}Si_2P_2Cu_1$ | Amo | 389 | 536 | 147 | 3.6 | 1.56 |
| Example 10 | $Fe_{86}B_9Si_2P_2Cu_1$ | Amo | 376 | 529 | 153 | 28.8 | 1.56 |
| Comparative Example 10 | $Fe_{87}B_8Si_2P_2Cu_1$ | Cry | Continuous strip cannot be obtained. | | | | |

Amo: Amorphous; Cry: Crystal

TABLE 3

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Comparative Example 11 | $Fe_{83.3}B_4Si_7P_5Cu_{0.7}$ | Cry | 383 | 549 | 166 | 25.2 | 1.54 |
| Example 11 | $Fe_{83.3}B_5Si_6P_5Cu_{0.7}$ | Amo | 422 | 557 | 135 | 13.8 | 1.56 |
| Example 12 | $Fe_{83.3}B_6Si_5P_5Cu_{0.7}$ | Amo | 416 | 555 | 139 | 12.5 | 1.56 |
| Example 13 | $Fe_{83.3}B_8Si_4P_4Cu_{0.7}$ | Amo | 411 | 547 | 136 | 7.2 | 1.65 |
| Example 14 | $Fe_{83.3}B_{10}Si_3P_3Cu_{0.7}$ | Amo | 419 | 558 | 139 | 10.6 | 1.57 |
| Example 15 | $Fe_{85.0}B_{10}Si_2P_2Cu_1$ | Amo | 389 | 536 | 147 | 3.6 | 1.56 |
| Example 16 | $Fe_{83.3}B_{12}Si_2P_2Cu_{0.7}$ | Amo | 426 | 549 | 123 | 10.5 | 1.57 |
| Example 17 | $Fe_{83.3}B_{13}Si_1P_2Cu_{0.7}$ | Amo | 430 | 539 | 109 | 15.1 | 1.58 |
| Comparative Example 12 | $Fe_{83.3}B_{14}Si_1P_1Cu_{0.7}$ | Cry | 425 | 529 | 104 | 13 | 1.57 |

Amo: Amorphous; Cry: Crystal

TABLE 4

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Example 18 | $Fe_{85.3}B_{10}Si_{0.1}P_{3.9}Cu_{0.7}$ | Amo | 397 | 528 | 131 | 13.4 | 1.58 |
| Example 19 | $Fe_{85.3}B_{10}Si_{0.5}P_{3.5}Cu_{0.7}$ | Amo | 396 | 535 | 139 | 10.7 | 1.58 |
| Example 20 | $Fe_{85.3}B_{10}Si_1P_3Cu_{0.7}$ | Amo | 397 | 528 | 131 | 12.8 | 1.57 |
| Example 21 | $Fe_{85.3}B_{10}Si_2P_2Cu_{0.7}$ | Amo | 395 | 548 | 153 | 11 | 1.59 |
| Example 22 | $Fe_{83.3}B_8Si_2P_6Cu_{0.7}$ | Amo | 416 | 535 | 119 | 14.4 | 1.56 |
| Example 23 | $Fe_{83.3}B_8Si_4P_4Cu_{0.7}$ | Amo | 411 | 547 | 136 | 7.2 | 1.65 |
| Example 24 | $Fe_{83.3}B_8Si_6P_2Cu_{0.7}$ | Amo | 420 | 571 | 151 | 16.6 | 1.56 |
| Example 25 | $Fe_{81.3}B_7Si_8P_3Cu_{0.7}$ | Amo | 451 | 566 | 115 | 7.5 | 1.56 |
| Comparative Example 13 | $Fe_{81.3}B_6Si_{10}P_2Cu_{0.7}$ | Cry | 390 | 574 | 184 | 144.5 | 1.57 |

Amo: Amorphous; Cry: Crystal

TABLE 5

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Comparative Example 14 | $Fe_{83.3}B_{12}Si_4Cu_{0.7}$ | Amo | 423 | 530 | 107 | 7.5 | 1.58 |
| Comparative Example 15 | $Fe_{82.7}B_{12}Si_4Cu_{1.3}$ | Amo | 375 | 520 | 145 | 7 | 1.57 |
| Comparative Example 16 | $Fe_{83.3}B_8Si_8P_0Cu_{0.7}$ | Cry | 367 | 554 | 187 | 16.3 | 1.59 |
| Example 26 | $Fe_{83.3}B_8Si_7P_1Cu_{0.7}$ | Amo | 420 | 571 | 151 | 16.6 | 1.56 |
| Example 27 | $Fe_{83.3}B_8Si_6P_2Cu_{0.7}$ | Amo | 420 | 571 | 151 | 16.6 | 1.56 |
| Example 28 | $Fe_{85.3}B_{10}Si_1P_3Cu_{0.7}$ | Amo | 397 | 528 | 131 | 12.8 | 1.57 |
| Example 29 | $Fe_{83.3}B_{10}Si_3P_3Cu_{0.7}$ | Amo | 419 | 558 | 139 | 10.6 | 1.57 |
| Example 30 | $Fe_{83.3}B_8Si_4P_4Cu_{0.7}$ | Amo | 441 | 547 | 136 | 7.2 | 1.65 |
| Example 31 | $Fe_{83.3}B_7Si_4P_5Cu_{0.7}$ | Amo | 420 | 550 | 130 | 14.8 | 1.56 |
| Example 32 | $Fe_{83.3}B_6Si_4P_6Cu_{0.7}$ | Amo | 416 | 535 | 119 | 14.1 | 1.56 |
| Example 33 | $Fe_{82.3}B_7Si_2P_8Cu_{0.7}$ | Amo | 408 | 519 | 111 | 12 | 1.56 |
| Comparative Example 17 | $Fe_{81.3}B_6Si_2P_{10}Cu_{0.7}$ | Cry | 425 | 523 | 98 | 8 | 1.51 |

Amo: Amorphous; Cry: Crystal

TABLE 6

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Example 34 | $Fe_{83.3}B_8Si_4P_4Cu_{0.7}$ | Amo | 411 | 547 | 136 | 7.2 | 1.65 |
| Example 35 | $Fe_{83.3}B_8Si_4P_3C_1Cu_{0.7}$ | Amo | 408 | 552 | 144 | 6 | 1.59 |
| Example 36 | $Fe_{83.3}B_7Si_4P_4C_1Cu_{0.7}$ | Amo | 402 | 546 | 144 | 8 | 1.56 |
| Example 37 | $Fe_{83.3}B_7Si_4P_3C_2Cu_{0.7}$ | Amo | 413 | 554 | 141 | 6 | 1.58 |
| Example 38 | $Fe_{83.3}B_7Si_3P_2C_4Cu_{0.7}$ | Amo | 404 | 561 | 157 | 23.7 | 1.58 |
| Example 39 | $Fe_{83.3}B_7Si_2P_2C_5Cu_{0.7}$ | Amo | 404 | 553 | 149 | 14.6 | 1.62 |
| Comparative Example 18 | $Fe_{83.3}B_6Si_2P_2C_6Cu_{0.7}$ | Cry | 406 | 556 | 150 | 10.4 | 1.59 |

Amo: Amorphous; Cry: Crystal

TABLE 7

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Comparative Example 19 | $Fe_{84}B_8Si_4P_4$ | Amo | 445 | 539 | 94 | 12 | 1.61 |
| Comparative Example 20 | $Fe_{83.7}B_8Si_4P_4Cu_{0.3}$ | Amo | 439 | 551 | 112 | 5.5 | 1.57 |
| Example 40 | $Fe_{83.6}B_8Si_4P_4Cu_{0.4}$ | Amo | 427 | 552 | 125 | 6 | 1.56 |
| Example 41 | $Fe_{83.5}B_8Si_4P_4Cu_{0.5}$ | Amo | 425 | 556 | 131 | 6.3 | 1.57 |
| Example 42 | $Fe_{83.3}B_8Si_4P_4Cu_{0.7}$ | Amo | 411 | 547 | 136 | 7.2 | 1.65 |
| Example 43 | $Fe_{83.0}B_8Si_4P_4Cu_{1.0}$ | Amo | 441 | 552 | 111 | 5.7 | 1.59 |
| Example 44 | $Fe_{85.0}B_8Si_2P_4Cu_{1.0}$ | Amo | 389 | 537 | 148 | 9 | 1.61 |
| Example 45 | $Fe_{82.7}B_8Si_4P_4Cu_{1.3}$ | Amo | 387 | 537 | 150 | 7.5 | 1.58 |
| Example 46 | $Fe_{82.6}B_8Si_4P_4Cu_{1.4}$ | Amo | 408 | 556 | 148 | 40 | 1.57 |
| Comparative Example 21 | $Fe_{82.5}B_8Si_4P_4Cu_{1.5}$ | Cry | 388 | 551 | 163 | 5.8 | 1.56 |
| Comparative Example 22 | $Fe_{84.5}B_{10}Si_2P_2Cu_{1.5}$ | Cry | 358 | 534 | 176 | 110 | 1.57 |

Amo: Amorphous; Cry: Crystal

TABLE 8

| | Magnetic Permeability | Hc (A/m) | Bs (T) | Average Diameter (nm) | Heat Treatment Condition |
|---|---|---|---|---|---|
| Comparative Example 1 | | 170 | | x | 460° C. × 10 Minutes |
| Comparative Example 2 | | 115 | | x | 490° C. × 10 Minutes |
| Comparative Example 3 | | 220 | | x | 475° C. × 10 Minutes |
| Comparative Example 4 | | 320 | | x | 460° C. × 10 Minutes |
| Comparative Example 5 | 7000 | 100 | 1.80 | x | 450° C. × 10 Minutes |
| Comparative Example 6 | 600 | 220 | 1.67 | x | 430° C. × 10 Minutes |
| Comparative Example 7 | 2000 | 570 | 1.83 | x | 450° C. × 10 Minutes |
| Comparative Example 8 | 1000 | 150 | 1.67 | x | 450° C. × 10 Minutes |

TABLE 9

| | Magnetic Permeability | Hc (A/m) | Bs (T) | Average Diameter (nm) | Heat Treatment Condition |
|---|---|---|---|---|---|
| Comparative Example 9 | 11000 | 8.2 | 1.63 | 19 | 475° C. × 10 Minutes |
| Example 1 | 14000 | 4.5 | 1.67 | 21 | 475° C. × 10 Minutes |
| Example 2 | 18000 | 3.3 | 1.69 | 18 | 475° C. × 10 Minutes |
| Example 3 | 21000 | 12 | 1.77 | 20 | 480° C. × 10 Minutes |
| Example 4 | 19000 | 10 | 1.79 | 22 | 480° C. × 10 Minutes |
| Example 5 | 30000 | 7 | 1.88 | 15 | 475° C. × 10 Minutes |
| Example 6 | 20000 | 10 | 1.94 | 17 | 450° C. × 30 Minutes |
| Example 7 | 16000 | 16 | 1.97 | 21 | 430° C. × 10 Minutes |
| Example 8 | 11000 | 20 | 2.01 | 24 | 430° C. × 10 Minutes |

TABLE 9-continued

| | Magnetic Permeability | Hc (A/m) | Bs (T) | Average Diameter (nm) | Heat Treatment Condition |
|---|---|---|---|---|---|
| Example 9 | 22000 | 9 | 1.82 | 18 | 460° C. × 10 Minutes |
| Example 10 | 11000 | 15.3 | 1.92 | 20 | 460° C. × 10 Minutes |
| Comparative Example 10 | Continuous strip cannot be obtained. | | | | |

TABLE 10

| | Magnetic Permeability | Hc (A/m) | Bs (T) | Average Diameter (nm) | Heat Treatment Condition |
|---|---|---|---|---|---|
| Comparative Example 11 | 700 | 129 | 1.70 | x | 475° C. × 10 Minutes |
| Example 11 | 12000 | 18 | 1.77 | 24 | 475° C. × 10 Minutes |
| Example 12 | 24000 | 5 | 1.79 | 21 | 450° C. × 10 Minutes |
| Example 13 | 30000 | 7 | 1.88 | 15 | 475° C. × 10 Minutes |
| Example 14 | 20000 | 5.4 | 1.82 | 14 | 475° C. × 10 Minutes |
| Example 15 | 22000 | 9 | 1.90 | 18 | 460° C. × 10 Minutes |
| Example 16 | 18000 | 8.2 | 1.83 | 17 | 450° C. × 10 Minutes |
| Example 17 | 14000 | 13.9 | 1.85 | 16 | 475° C. × 10 Minutes |
| Comparative Example 12 | 7000 | 24 | 1.86 | 18 | 460° C. × 10 Minutes |

TABLE 11

| | Magnetic Permeability | Hc (A/m) | Bs (T) | Average Diameter (nm) | Heat Treatment Condition |
|---|---|---|---|---|---|
| Example 18 | 11000 | 14 | 1.89 | 16 | 450° C. × 10 Minutes |
| Example 19 | 13000 | 9.5 | 1.90 | 17 | 450° C. × 10 Minutes |
| Example 20 | 23000 | 6.8 | 1.92 | 14 | 450° C. × 10 Minutes |
| Example 21 | 16000 | 16 | 1.97 | 21 | 430° C. × 10 Minutes |
| Example 22 | 19000 | 4.1 | 1.78 | 16 | 450° C. × 10 Minutes |
| Example 23 | 30000 | 1 | 1.88 | 15 | 475° C. × 10 Minutes |
| Example 24 | 18000 | 10.7 | 1.84 | 19 | 475° C. × 10 Minutes |
| Example 25 | 21000 | 12 | 1.73 | 20 | 475° C. × 10 Minutes |
| Comparative Example 13 | 7700 | 31 | 1.73 | x | 475° C. × 10 Minutes |

TABLE 12

| | Magnetic Permeability | Hc (A/m) | Bs (T) | Average Diameter (nm) | Heat Treatment Condition |
|---|---|---|---|---|---|
| Comparative Example 14 | 400 | 670 | 1.85 | x | 475° C. × 10 Minutes |
| Comparative Example 15 | 9000 | 68 | 1.7 | x | 450° C. × 10 Minutes |
| Comparative Example 16 | 1700 | 68 | 1.79 | x | 450° C. × 10 Minutes |
| Example 26 | 12000 | 14 | 1.81 | 19 | 450° C. × 10 Minutes |
| Example 27 | 19000 | 10.7 | 1.80 | 16 | 450° C. × 10 Minutes |
| Example 28 | 23000 | 6.8 | 1.92 | 14 | 450° C. × 10 Minutes |
| Example 29 | 26000 | 5.4 | 1.84 | 13 | 450° C. × 10 Minutes |
| Example 30 | 30000 | 7 | 1.88 | 15 | 475° C. × 10 Minutes |
| Example 31 | 22000 | 4.6 | 1.74 | 16 | 450° C. × 10 Minutes |
| Example 32 | 14000 | 4.1 | 1.69 | 17 | 450° C. × 10 Minutes |
| Example 33 | 17000 | 4.5 | 1.69 | 16 | 450° C. × 10 Minutes |
| Comparative Example 17 | 1700 | 68 | 1.65 | x | 450° C. × 10 Minutes |

TABLE 13

| | Magnetic Permeability | Hc (A/m) | Bs (T) | Average Diameter (nm) | Heat Treatment Condition |
|---|---|---|---|---|---|
| Example 34 | 30000 | 7 | 1.88 | 15 | 475° C. × 10 Minutes |
| Example 35 | 21000 | 7 | 1.87 | 20 | 460° C. × 30 Minutes |
| Example 36 | 22000 | 7 | 1.87 | 20 | 460° C. × 30 Minutes |

TABLE 13-continued

| | Magnetic Permeability | Hc (A/m) | Bs (T) | Average Diameter (nm) | Heat Treatment Condition |
|---|---|---|---|---|---|
| Example 37 | 26000 | 8 | 1.87 | 16 | 460° C. × 30 Minutes |
| Example 38 | 11000 | 19 | 1.85 | 20 | 450° C. × 30 Minutes |
| Example 39 | 13000 | 16.3 | 1.82 | 22 | 450° C. × 30 Minutes |
| Comparative Example 18 | 3900 | 28.8 | 1.83 | x | 450° C. × 30 Minutes |

TABLE 14

| | Magnetic Permeability | Hc (A/m) | Bs (T) | Average Diameter (nm) | Heat Treatment Condition |
|---|---|---|---|---|---|
| Comparative Example 19 | 2000 | 300 | 1.70 | x | 475° C. × 10 Minutes |
| Comparative Example 20 | 900 | 80 | 1.79 | x | 490° C. × 10 Minutes |
| Example 40 | 16000 | 10 | 1.84 | 23 | 470° C. × 10 Minutes |
| Example 41 | 19000 | 9.5 | 1.83 | 21 | 470° C. × 10 Minutes |
| Example 42 | 30000 | 7 | 1.88 | 15 | 475° C. × 10 Minutes |
| Example 43 | 21000 | 8.2 | 1.86 | 19 | 450° C. × 10 Minutes |
| Example 44 | 25000 | 6 | 1.85 | 16 | 450° C. × 10 Minutes |
| Example 45 | 18000 | 6 | 1.81 | 22 | 475° C. × 10 Minutes |
| Example 46 | 23000 | 7.2 | 1.77 | 12 | 475° C. × 10 Minutes |
| Comparative Example 21 | 3200 | 54 | 1.68 | x | 475° C. × 10 Minutes |
| Comparative Example 22 | 4100 | 33 | 1.85 | x | 450° C. × 10 Minutes |

As understood from Tables 1 to 7, each of the alloy compositions of Examples 1-46 has an amorphous phase as a main phase after the rapid cooling process.

As understood from Tables 8 to 14, each of the heat-treated alloy composition of Examples 1-46 is nano-crystallized so that the bccFe phase included therein has an average diameter of 25 nm or smaller. On the other hand, each of the heat-treated alloy composition of Comparative Examples 1-22 has various particle sizes or heterogeneous particle sizes or is not nano-crystallized (in columns "Average Diameter" of Tables 8 to 14, "x" shows a not-nano-crystallized alloy. Similar results are understood from FIG. 1. Graphs of Comparative Examples 7, 14 and 15 show that their coercivity Hc become larger at increasing process temperatures. On the other hand, graphs of Examples 5 and 6 include curves in which their coercivity Hc are reduced at increasing process temperatures. The reduced coercivity Hc is caused by nano-crystallization.

Figure 2:
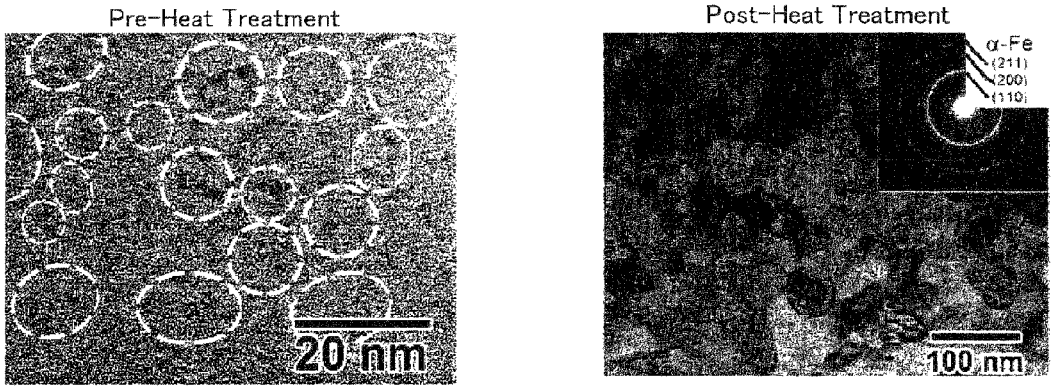
FIG. 2 is a set of copies of high-resolution TEM images of a comparative example, wherein the left shows an image for a pre-heat-treatment state, and the right shows an image for a post-heat-treatment.
Figure 3:
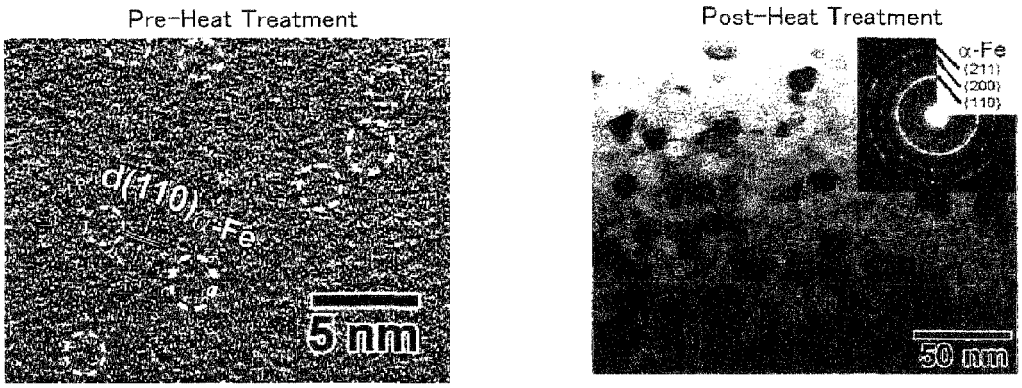
FIG. 3 is a set of copies of high-resolution TEM images of an example of the present invention, wherein the left shows an image for a pre-heat-treatment state, and the right shows an image for a post-heat-treatment.

With reference to FIG. 2, the pre-heat-treatment alloy composition of Comparative Example 7 has initial microcrystals which have diameters larger than 10 nm so that the strip of the alloy composition cannot be flat on itself but is broken upon the 180 degree bend test. With reference to FIG. 3, the pre-heat-treatment alloy composition of Example 5 has initial microcrystals which have diameters of 10 nm or smaller so that the strip of alloy composition can be flat on itself upon the 180 degree bend test. In addition, FIG. 3 shows that the post-heat-treatment alloy composition, i.e. the Fe-based nano-crystalline alloy of Example 5 has homogeneous Fe-based nanocrystals, which have an average diameter of 15 nm smaller than 25 nm and provide a superior coercivity Hc property of FIG. 1. The other Examples 1-4, 6-46 are similar to Example 5. Each of the pre-heat-treatment alloy compositions thereof has initial microcrystals existing in an amorphous phase which have diameters of 10 nm or smaller Each of the post-heat-treatment alloy compositions (the Fe-based nano-crystalline alloys) thereof has homogeneous Fe-based nanocrystals, which have an average diameter of 15 nm smaller than 25 nm. Therefore, each of the post-heat-treatment alloy compositions (the Fe-based nano-crystalline alloys) of Examples 1-46 can have a superior coercivity Hc property.

Figure 4:
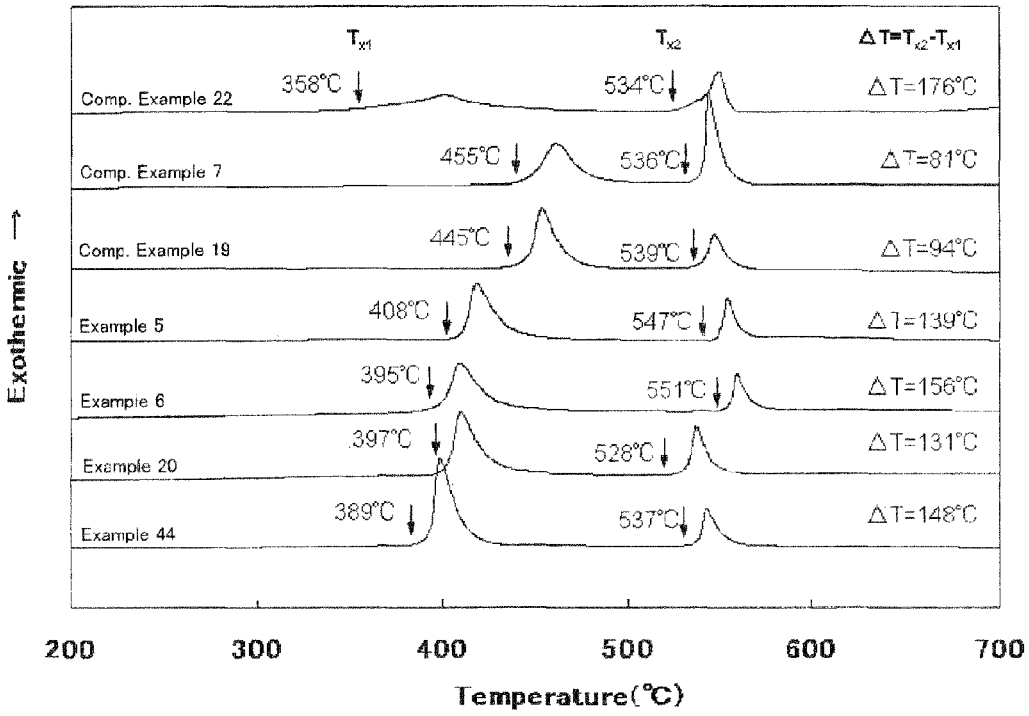
FIG. 4 is a view showing DSC profiles of examples of the present invention and DSC profiles of comparative examples.

As understood from Tables 1 to 7, each of the alloy compositions of Examples 1-46 has a crystallization start temperature difference ΔT ($=T_{x2}-T_{x1}$) of 100° C. or more. The alloy composition is exposed to a heat treatment under the condition that its maximum instantaneous heat treatment temperature is in a range between its first crystallization start temperature $T_{x1}$ and its second crystallization start temperature $T_{x2}$, so that superior soft magnetic properties (coercivity Hc, magnetic permeability p) can be obtained as shown in Tables 1 to 14. FIG. 4 also shows that each of the alloy compositions of Examples 5, 6, 20 and 44 has its crystallization start temperature difference ΔT of 100° C. or more. On the other hand, DSC curves of FIG. 4 show that the alloy compositions of Comparative Examples 7 and 19 have narrow crystallization start temperature differences ΔT, respectively. Because of the narrow crystallization start temperature differences ΔT, the post-heat-treatment alloy compositions of Comparative Examples 7 and 19 have inferior soft magnetic properties. In FIG. 4, the alloy composition of Comparative Example 22 appears to have a broad crystallization start temperature difference ΔT. However, the broad crystallization start temperature difference ΔT is caused by the fact that its main phase is a crystal phase as shown in Table 7. Therefore, the post-heat-treatment alloy composition of Comparative Example 22 has inferior soft magnetic properties.

The alloy compositions of Examples 1-10 and Comparative Examples 9 and 10 listed in Tables 8 and 9 correspond to the cases where the Fe content is varied from 79 atomic % to 87 atomic %. Each of the alloy compositions of Examples 1-10 listed in Table 9 has magnetic permeability μ of 10,000 or more, saturation magnetic flux density Bs of 1.65 T or more and coercivity Hc of 20 A/m or less. Therefore, a range of from 79 atomic % to 86 atomic % defines a condition range for the Fe content. If the Fe content is 81 atomic % or more, the saturation magnetic flux density Bs of 1.7 T or more can be obtained. Therefore, it is preferable that the Fe content is 81 atomic % or more in a field, such as a transformer or a motor, where high saturation magnetic flux density Bs is required. On the other hand, the Fe content of Comparative Example 9 is 78 atomic %. The alloy composition of Comparative Example 9 has an amorphous phase as its main phase as shown in Table 2. However, the post-heat-treatment crystalline particles are rough as shown in Table 9 so that its magnetic permeability μ and its coercivity Hc are out of the above-mentioned property range of Examples 1-10. The Fe content of Comparative Example 10 is 87 atomic %. The alloy composition of Comparative Example 10 cannot form a continuous strip. In addition, the alloy composition of Comparative Example 10 has a crystalline phase as its main phase.

The alloy compositions of Examples 11-17 and Comparative Examples 11 and 12 listed in Table 10 correspond to the cases where the B content is varied from 4 atomic % to 14 atomic %. Each of the alloy compositions of Examples 11-17 listed in Table 10 has magnetic permeability μ of 10,000 or more, saturation magnetic flux density Bs of 1.65 T or more and coercivity Hc of 20 A/m or less. Therefore, a range of from 5 atomic % to 13 atomic % defines a condition range for the B content. In particular, it is preferable that the B content is 10 atomic % or less so that the alloy composition has a broad crystallization start temperature difference ΔT of 120° C. or more and a temperature at which the alloy composition finishes to be melt becomes lower than that of Fe amorphous alloy. The B content of Comparative Example 11 is 4 atomic %, and the B content of Comparative Example 12 is 14 atomic %. The alloy compositions of Comparative Examples 11, 12 have rough crystalline particles posterior to the heat treatment, as shown in Table 10, so that their magnetic permeability μ and their coercivity Hc are out of the above-mentioned property range of Examples 11-17.

The alloy compositions of Examples 18-25 and Comparative Example 13 listed in Table 11 correspond to the cases where the Si content is varied from 0.1 atomic % to 10 atomic %. Each of the alloy compositions of Examples 18-25 listed in Table 11 has magnetic permeability μ of 10,000 or more, saturation magnetic flux density Bs of 1.65 T or more and coercivity Hc of 20 A/m or less. Therefore, a range of from 0 atomic % to 8 atomic % (excluding zero atomic %) defines a condition range for the Si content. The B content of Comparative Example 13 is 10 atomic %. The alloy composition of Comparative Example 13 has low saturation magnetic flux density Bs and rough crystalline particles posterior to the heat treatment so that their magnetic permeability μ and their coercivity Hc are out of the above-mentioned property range of Examples 18-25.

The alloy compositions of Examples 26-33 and Comparative Examples 14-17 listed in Table 12 correspond to the cases where the P content is varied from 0 atomic % to 10 atomic %. Each of the alloy compositions of Examples 26-33 listed in Table 12 has magnetic permeability μ of 10,000 or more, saturation magnetic flux density Bs of 1.65 T or more and coercivity Hc of 20 A/m or less. Therefore, a range of from 1 atomic % to 8 atomic % defines a condition range for the P content. In particular, it is preferable that the P content is 5 atomic % or less so that the alloy composition has a broad crystallization start temperature difference ΔT of 120° C. or more and has saturation magnetic flux density Bs larger than 1.7 T. The P contents of Comparative Examples 14-16 are each 0 atomic %. The alloy compositions of Comparative Examples 14-16 have rough crystalline particles posterior to the heat treatment so that their magnetic permeability μ and their coercivity Hc are out of the above-mentioned property range of Examples 26-33. The P content of Comparative Example 17 is 10 atomic %. The alloy composition of Comparative Example 17 also has rough crystalline particles posterior to the heat treatment so that its magnetic permeability μ and its coercivity Hc are out of the above-mentioned property range of Examples 26-33.

The alloy compositions of Examples 34-39 and Comparative Example 18 listed in Table 13 correspond to the cases where the C content is varied from 0 atomic % to 6 atomic %. Each of the alloy compositions of Examples 34-39 listed in Table 13 has magnetic permeability μ of 10,000 or more, saturation magnetic flux density Bs of 1.65 T or more and coercivity Hc of 20 A/m or less. Therefore, a range of from 0 atomic % to 5 atomic % defines a condition range for the C content. Note here that, if the C content is 4 atomic % or more, its continuous strip has a thickness thicker than 30 μm, as Example 38 or 39, so that it is difficult to be flat on itself upon the 180 degree bend test. Therefore, it is preferable that the C content is 3 atomic % or less. The C content of Comparative Example 18 is 6 atomic %. The alloy composition of Comparative Example 18 has rough crystalline particles posterior to the heat treatment so that its magnetic permeability μ and its coercivity Hc are out of the above-mentioned property range of Examples 34-39.

The alloy compositions of Examples 40-46 and Comparative Examples 19-22 listed in Table 14 correspond to the cases where the Cu content is varied from 0 atomic % to 1.5 atomic %. Each of the alloy compositions of Examples 40-46 listed in Table 14 has magnetic permeability μ of 10,000 or more, saturation magnetic flux density Bs of 1.65 T or more and coercivity Hc of 20 A/m or less. Therefore, a range of from 0.4 atomic % to 1.4 atomic % defines a condition range for the Cu content. The Cu content of Comparative Example 19 is 0 atomic %, and the Cu content of Comparative Example 20 is 0.3 atomic %. The alloy compositions of Comparative Examples 19 and 20 have rough crystalline particles posterior to the heat treatment so that their magnetic permeability μ and their coercivity Hc are out of the above-mentioned property range of Examples 40-46. The Cu contents of Comparative Examples 21 and 22 are each 1.5 atomic %. The alloy compositions of Comparative Examples 21 and 22 also have rough crystalline particles posterior to the heat treatment so that their magnetic permeability μ and their coercivity Hc are out of the above-mentioned property range of Examples 40-46. In addition, the alloy compositions of Comparative Examples 21 and 22 each has, as its main phase, not an amorphous phase but a crystalline phase.

As for each of the Fe-based nano-crystalline alloys obtained by exposing the alloy compositions of Examples 1, 2, 5, 6 and 44, their saturation magnetostriction was measured by the strain gage method. As the result, the Fe-based nano-crystalline alloys of Examples 1, 2, 5, 6 and 44 had saturation magnetostriction of $8.2\times10^{-6}$, $5.3\times10^{-5}$, $3.8\times10^{-6}$, $3.1\times10^{-6}$ and $2.3\times10^{-6}$, respectively. On the other hand, the saturation magnetostriction of Fe amorphous is $27\times10^{-6}$, and the Fe-based nano-crystalline alloy of JP-A 2007-270271 (Patent Document 1) has saturation magnetostriction of $14\times10^{-6}$. In comparison therewith, the Fe-based nano-crystalline alloys of Examples 1, 2, 5, 6 and 44 have very smaller so as to have high magnetic permeability, low coercivity and low core loss. In other words, the reduced saturation magnetostriction contributes to improvement of soft magnetic properties and suppression of noise or vibration. Therefore, it is desirable that saturation magnetostriction is $10\times10^{-6}$ or less. In particular, in order to obtain magnetic permeability of 20,000 or more, it is preferable that saturation magnetostriction is $5\times10^{-6}$ or less.

Examples 47-55 and Comparative Examples 23-25

Materials were respectively weighed so as to provide alloy compositions of Examples 47-55 of the present invention and Comparative Examples 23-25 as listed in Table 15 below and were melted by the high-frequency induction melting process. The melted alloy compositions were processed by the single-roll liquid quenching method under the atmosphere so as to produce continuous strips which have thicknesses of about 20 μm and about 30 μm, a width of about 15 mm and a length of about 10 m. For each of the continuous strip of the alloy compositions, phase identification was carried out through the X-ray diffraction method. Toughness of each continuous strip was evaluated by the 180 degree bend test. For each continuous strip having the thickness of about 20 μm, the first crystallization start temperature and the second crystallization start temperature were evaluated by using a differential scanning calorimetory (DSC). In addition, for Examples 47-55 and Comparative Examples 23-25, the alloy compositions of about 20 μm thickness were exposed to heat treatment processes which were carried out under the heat treatment conditions listed in Table 16. Saturation magnetic flux density Bs of each of the heat-treated alloy compositions was measured by using a vibrating-sample magnetometer (VMS) under a magnetic field of 800 kA/m. Coercivity Hc of each alloy composition was measured by using a direct current BH tracer under a magnetic field of 2 kA/m. The measurement results are shown in Tables 15 and 16.

TABLE 15

| | Alloy Composition (at %) | z/x | Thickness (μm) | Phase (XRD) | Bent Test | $T_{X1}$ (° C.) | $T_{X2}$ (° C.) | ΔT (° C.) | Hc (A/m) | Bs (T) |
|---|---|---|---|---|---|---|---|---|---|---|
| Comparative Example 23 | $Fe_{83.7}B_8Si_4P_4Cu_{0.3}$ | 0.06 | 22 | Amo | ○ | 436 | 552 | 116 | 9.4 | 1.56 |
| | | | 29 | Amo | ○ | — | — | — | — | — |
| Example 47 | $Fe_{83.6}B_8Si_4P_4Cu_{0.4}$ | 0.08 | 19 | Amo | ○ | 426 | 558 | 132 | 10.1 | 1.56 |
| | | | 31 | Amo | ○ | — | — | — | — | — |
| Example 48 | $Fe_{83.3}B_8Si_4P_4Cu_{0.7}$ | 0.175 | 20 | Amo | ○ | 413 | 557 | 144 | 8.2 | 1.60 |
| | | | 32 | Amo | ○ | — | — | — | — | — |
| Example 49 | $Fe_{84.9}B_{10}Si_{0.1}P_{3.9}Cu_{1.1}$ | 0.26 | 19 | Amo | ○ | 395 | 529 | 134 | 11.3 | 1.58 |
| | | | 28 | Cry | x | — | — | — | — | — |
| Example 50 | $Fe_{84.9}B_{10}Si_{0.5}P_{3.5}Cu_{1.1}$ | 0.34 | 18 | Amo | ○ | 396 | 535 | 139 | 11.2 | 1.57 |
| | | | 29 | Cry | x | — | — | — | — | — |
| Example 51 | $Fe_{84.9}B_{10}Si_1P_3Cu_{1.1}$ | 0.4 | 21 | Amo | ○ | 374 | 543 | 169 | 14 | 1.58 |
| | | | 27 | Cry | x | — | — | — | — | — |
| Example 52 | $Fe_{84.9}B_{10}Si_2P_2Cu_{1.1}$ | 0.55 | 18 | Amo | ○ | 394 | 548 | 154 | 9.5 | 1.56 |
| | | | 26 | Amo | ○ | — | — | — | — | — |
| Example 53 | $Fe_{84.8}B_{10}Si_2P_2Cu_{1.2}$ | 0.6 | 22 | Amo | ○ | 398 | 549 | 151 | 17 | 1.56 |
| | | | 28 | Amo | Δ | — | — | — | — | — |
| Example 54 | $Fe_{84.8}B_{10}Si_{2.5}P_{1.5}Cu_{1.2}$ | 0.8 | 21 | Amo | ○ | 388 | 546 | 158 | 18.2 | 1.56 |
| | | | 26 | Amo | Δ | — | — | — | — | — |
| Example 55 | $Fe_{85.3}B_{10}Si_3P_1Cu_{0.7}$ | 0.7 | 19 | Amo | ○ | 395 | 548 | 153 | 15.4 | 1.55 |
| | | | 29 | Cry | x | — | — | — | — | — |
| Comparative Example 24 | $Fe_{84.8}B_{10}Si_3P_1Cu_{1.2}$ | 1.2 | 21 | Amo | x | 394 | 539 | 145 | 35.5 | 1.57 |
| | | | 27 | Cry | x | — | — | — | — | — |
| Comparative Example 25 | $Fe_{84.8}B_{10}Si_4Cu_{1.2}$ | | 20 | Cry | x | — | — | — | — | — |
| | | | 26 | Cry | x | — | — | — | — | — |

Amo: Amorphous; Cry: Crystal

TABLE 16

| | Magnetic Permeability | Hc (A/m) | Bs (T) | Average Diameter (nm) | Heat Treatment Condition |
|---|---|---|---|---|---|
| Comparative Example 23 | 1200 | 130 | 1.78 | x | 475° C. × 10 Minutes |
| Example 47 | 12000 | 18 | 1.84 | 18 | 475° C. × 10 Minutes |
| Example 48 | 25000 | 6.4 | 1.83 | 15 | 475° C. × 10 Minutes |
| Example 49 | 23000 | 14.6 | 1.88 | 16 | 450° C. × 10 Minutes |
| Example 50 | 14000 | 9.5 | 1.87 | 16 | 450° C. × 10 Minutes |
| Example 51 | 27000 | 9 | 1.88 | 12 | 450° C. × 10 Minutes |
| Example 52 | 14000 | 16.9 | 1.91 | 15 | 450° C. × 10 Minutes |
| Example 53 | 21000 | 8 | 1.90 | 10 | 450° C. × 10 Minutes |
| Example 54 | 20000 | 14 | 1.90 | 15 | 450° C. × 10 Minutes |
| Example 55 | 16000 | 18 | 1.92 | 15 | 450° C. × 10 Minutes |
| Comparative Example 24 | 4500 | 36 | 1.89 | x | 450° C. × 10 Minutes |
| Comparative Example 25 | x | x | x | x | 450° C. × 10 Minutes |

As understood from Table 15, each of the continuous strips of about 20 μm thickness formed of the alloy compositions of Examples 47-55 has an amorphous phase as a main phase after the rapid cooling process and is capable of being flat on itself upon the 180 degree bend test.

The alloy compositions of Examples 47-55 and Comparative Examples 23, 24 listed in Table 16 correspond to the cases where the specific ratio z/x is varied from 0.06 to 1.2. Each of the alloy compositions of Examples 47-55 listed in Table 16 has magnetic permeability μ of 10,000 or more, saturation magnetic flux density Bs of 1.65 T or more and coercivity Hc of 20 A/m or less. Therefore, a range of from 0.08 to 0.8 defines a condition range for the specific ratio z/x. As understood from Examples 52-54, if the specific ratio z/x is larger than 0.55, the strip of about 30 μm thickness becomes brittle so as to be partially broken (Δ) or completely broken (x) upon the 180 degree bend test. Therefore, it is preferable that the specific ratio z/x is 0.55 or less. Likewise, because the strip becomes brittle if the Cu content is larger than 1.1 atomic %, it is preferable that the Cu content is 1.1 atomic % or less.

The alloy compositions of Examples 47-55 and Comparative Example 23 listed in Table 16 correspond to the cases where the Si content is varied from 0 to 4 atomic %. Each of the alloy compositions of Examples 47-55 listed in Table 16 has magnetic permeability μ of 10,000 or more, saturation magnetic flux density Bs of 1.65 T or more and coercivity Hc of 20 A/m or less. Therefore, it is understood that a range larger than 0 atomic % defines a condition range for the Si content, as mentioned above. As understood from Examples 49-53, if the Si content is less than 2 atomic %, the alloy composition becomes crystallized and becomes brittle so that it is difficult to form a thicker continuous strip. Therefore, in consideration of toughness, it is preferable that the Si content is 2 atomic % or more.

The alloy compositions of Examples 47-55 and Comparative Examples 23-25 listed in Table 16 correspond to the cases where the P content is varied from 0 to 4 atomic %. Each of the alloy compositions of Examples 47-55 listed in Table 16 has magnetic permeability μ of 10,000 or more, saturation magnetic flux density Bs of 1.65 T or more and coercivity Hc of 20 A/m or less. Therefore, it is understood that a range larger than 1 atomic % defines a condition range for the P content, as mentioned above. As understood from Examples 52-55, if the P content is less than 2 atomic %, the alloy composition becomes crystallized and becomes brittle so that it is difficult to form a thicker continuous strip. Therefore, in consideration of toughness, it is preferable that the P content is 2 atomic % or more.

Examples 56-64 and Comparative Example 26

Materials were respectively weighed so as to provide alloy compositions of Examples 56-64 of the present invention and Comparative Example 26 as listed in Tables 17 below and were arc melted. The melted alloy compositions were processed by the single-roll liquid quenching method under the atmosphere so as to produce continuous strips which have various thicknesses, a width of about 3 mm and a length of about 5 to 15 m. For each of the continuous strip of the alloy compositions, phase identification was carried out through the X-ray diffraction method. Their first crystallization start temperatures and their second crystallization start temperatures were evaluated by using a differential scanning calorimetory (DSC). In addition, the alloy compositions of Examples 56-64 and Comparative Example 26 were exposed to heat treatment processes which were carried out under the heat treatment conditions listed in Table 18. Saturation magnetic flux density Bs of each of the heat-treated alloy compositions was measured by using a vibrating-sample magnetometer (VMS) under a magnetic field of 800 kA/m. Coercivity Hc of each alloy composition was measured by using a direct current BH tracer under a magnetic field of 2 kA/m. Magnetic permeability μ was measured by using an impedance analyzer under conditions of 0.4 A/m and 1 kHz. The measurement results are shown in Tables 17 and 18.

TABLE 17

| | Alloy Composition (at %) | Phase (XRD) | $T_{X1}$ (° C.) | $T_{X2}$ (° C.) | ΔT (° C.) | Hc (A/m) | Bs (T) |
|---|---|---|---|---|---|---|---|
| Example 56 | $Fe_{83.3}B_8Si_4P_4Cu_{0.7}$ | Amo | 411 | 547 | 136 | 7.2 | 1.65 |
| Example 57 | $Fe_{82.8}B_8Si_4P_4Cu_{0.7}Cr_{0.5}$ | Amo | 418 | 561 | 143 | 12 | 1.6 |
| Example 58 | $Fe_{82.3}B_8Si_4P_4Cu_{0.7}Cr_1$ | Amo | 420 | 564 | 144 | 14.8 | 1.56 |
| Example 59 | $Fe_{81.3}B_8Si_4P_4Cu_{0.7}Cr_2$ | Amo | 422 | 568 | 146 | 6.6 | 1.5 |
| Example 60 | $Fe_{80.3}B_8Si_4P_4Cu_{0.7}Cr_3$ | Amo | 427 | 574 | 147 | 7.4 | 1.42 |
| Comparative Example 26 | $Fe_{79.3}B_8Si_4P_4Cu_{0.7}Cr_4$ | Amo | 430 | 578 | 148 | 13.5 | 1.34 |
| Example 61 | $Fe_{81.3}B_8Si_4P_4Cu_{0.7}Nb_2$ | Amo | 435 | 613 | 178 | 8.7 | 1.36 |
| Example 62 | $Fe_{81.3}B_8Si_4P_4Cu_{0.7}Ni_2$ | Amo | 418 | 553 | 135 | 8.1 | 1.59 |
| Example 63 | $Fe_{81.3}B_8Si_4P_4Cu_{0.7}Co_2$ | Amo | 415 | 561 | 146 | 8.4 | 1.63 |
| Example 64 | $Fe_{81.3}B_8Si_4P_4Cu_{0.7}Al_1$ | Amo | 426 | 549 | 123 | 13 | 1.60 |

Amo: Amorphous; Cry: Crystal

TABLE 18

| | Magnetic Permeability | Hc (A/m) | Bs (T) | Average Diameter (nm) | Heat Treatment Condition |
|---|---|---|---|---|---|
| Example 56 | 30000 | 7 | 1.88 | 15 | 475° C. × 10 Minutes |
| Example 57 | 28000 | 6.0 | 1.8 | 16 | 475° C. × 10 Minutes |
| Example 58 | 24000 | 7.2 | 1.74 | 17 | 475° C. × 10 Minutes |
| Example 59 | 27000 | 6.4 | 1.71 | 15 | 475° C. × 10 Minutes |
| Example 60 | 25000 | 4.9 | 1.66 | 16 | 475° C. × 10 Minutes |
| Comparative Example 26 | 22000 | 7.0 | 1.63 | 16 | 475° C. × 10 Minutes |
| Example 61 | 23000 | 5.2 | 1.68 | 14 | 475° C. × 10 Minutes |
| Example 62 | 29000 | 5.0 | 1.81 | 16 | 450° C. × 10 Minutes |
| Example 63 | 24000 | 5.4 | 1.89 | 14 | 450° C. × 10 Minutes |
| Example 64 | 16000 | 9. | 1.83 | 14 | 450° C. × 10 Minutes |

As understood from Table 17, each of the alloy compositions of Examples 56-64 has an amorphous phase as a main phase after the rapid cooling process.

The alloy compositions of Examples 56-64 and Comparative Example 26 listed in Table 18 correspond to the cases where the Fe content is replaced in part with Nb elements, Cr elements Co elements and Co elements. Each of the alloy compositions of Examples 56-64 listed in Table 18 has magnetic permeability μ of 10,000 or more, saturation magnetic flux density Bs of 1.65 T or more and coercivity Hc of 20 A/m or less. Therefore, a range of from 0 atomic % to 3 atomic % defines a replacement allowable range for the Fe content.

The replaced Fe content of Comparative Example 26 is 4 atomic %. The alloy compositions of Comparative Example 26 has low saturation magnetic flux density Bs, which is out of the above-mentioned property range of Examples 56-64.

Examples 65-69 and Comparative Examples 27-29

Materials were respectively weighed so as to provide alloy compositions of Examples 65-69 of the present invention and Comparative Examples 27-29 as listed in Table 19 below and were melted by the high-frequency induction melting process. The melted alloy compositions were processed by the single-roll liquid quenching method under the atmosphere so as to produce continuous strips which have a thickness of 25 μm, a width of 15 or 30 mm and a length of about 10 to 30 m. For each of the continuous strip of the alloy compositions, phase identification was carried out through the X-ray diffraction method. Toughness of each continuous strip was evaluated by the 180 degree bend test. In addition, the alloy compositions of Examples 65 and 66 were exposed to heat treatment processes which were carried out under the heat treatment conditions of 475° C.×10 minutes. Likewise, the alloy compositions of Examples 67 to 69 and Comparative Example 27 were exposed to heat treatment processes which were carried out under the heat treatment conditions of 450° C.×10 minutes, and the alloy composition of Comparative Example 28 was exposed to a heat treatment process which was carried out under the heat treatment condition of 425° C.×30 minutes. Saturation magnetic flux density Bs of each of the heat-treated alloy compositions was measured by using a vibrating-sample magnetometer (VMS) under a magnetic field of 800 kA/n. Coercivity Hc of each alloy composition was measured by using a direct current BH tracer under a magnetic field of 2 kA/m. Core loss of each alloy composition was measured by using an alternating current BH analyzer under excitation conditions of 50 Hz and 1.7 T. The measurement results are shown in Table 19.

As understood from Table 19, each of the alloy compositions of Examples 65-69 has an amorphous phase as a main phase after the rapid cooling process and is capable of being flat on itself upon the 180 degree bend test.

In addition, each of the Fe-based nano-crystalline alloys obtained by heat treating the alloy compositions of Examples 65-69 has saturation magnetic flux density Bs of 1.65 T or more and coercivity Hc of 20 A/m or less. Furthermore, each of the Fe-based nano-crystalline alloys of Examples 65-69 can be excited under the excitation condition of 1.7 T and has lower core loss than that of an electrical steel sheet. Therefore, the use thereof can provide a magnetic component or device which has a low energy-loss property.

Examples 70-74 and Comparative Examples 30, 31

Materials of Fe, Si, B, P and Cu were respectively weighed so as to provide alloy compositions of $Fe_{84.8}B_{10}Si_2P_2Cu_{1.2}$ and were melted by the high-frequency induction melting process. The melted alloy compositions were processed by the single-roll liquid quenching method under the atmosphere so as to produce continuous strips which have a thickness of about 25 μm, a width of 15 mm and a length of about 30 m. As a result of phase identification by the X-ray diffraction method, each of the continuous strip of the alloy compositions had an amorphous phase as its main phase. In addition, each continuous strip could be flat on itself upon the 180 degree bend test. Thereafter, the alloy compositions were exposed to heat treatment processes which were carried out under the heat treatment conditions where the holder was laid under 450° C.×10 minutes and their temperature increase rate was in a range of from 60 to 1200° C. per minute. Thus, the sample alloys of Examples 70-74 and Comparative Example 30 were obtained. Also, a grain-oriented electrical steel sheet was prepared as Comparative Example 31. Saturation magnetic flux density Bs of each of the heat-treated alloy compositions was measured by using a vibrating-sample magnetometer (VMS) under a magnetic field of 800 kA/m. Coercivity Hc of each alloy composition was measured by using a direct current BH tracer under a magnetic field of 2 kA/m. Core loss of each alloy composition was measured by using an alternating current BH analyzer under excitation conditions of 50 Hz and 1.7 T. The measurement results are shown in Table 20.

TABLE 19

| | | | Before Heat Treatment | | After Heat Treatment | | |
|---|---|---|---|---|---|---|---|
| | Alloy Composition (at %) | Width (mm) | Phase (XRD) | 180° Bent Test | Hc (A/m) | Bs (T) | Pcm (W/kg) |
| Example 65 | $Fe_{83.3}B_8Si_4P_4Cu_{0.7}$ | 15 | Amo | ○ | 6.4 | 1.86 | 0.42 |
| Example 66 | $Fe_{83.3}B_8Si_4P_4Cu_{0.7}$ | 30 | Amo | ○ | 6.7 | 1.85 | 0.45 |
| Example 67 | $Fe_{84.3}B_8Si_4P_3Cu_{0.7}$ | 15 | Amo | ○ | 8.9 | 1.88 | 0.81 |
| Example 68 | $Fe_{85.3}B_{10}Si_2P_2Cu_{0.7}$ | 15 | Amo | ○ | 11 | 1.93 | 0.81 |
| Example 69 | $Fe_{84.8}B_{10}Si_2P_2Cu_{1.2}$ | 15 | Amo | ○ | 8.3 | 1.90 | 0.61 |
| Comparative Example 27 | $Fe_{84.5}B_{10}Si_2P_2Cu_{1.5}$ | 15 | Cry | x | 37 | 1.87 | 1.73 |
| Comparative Example 28 | Fe Amorphous | 15 | Amo | ○ | 8 | 1.55 | Not Excited |
| Comparative Example 29 | Grain-Oriented Electrical Steel Sheet | | | | 23 | 2.01 | 1.39 |

Amo: Amorphous; Cry: Crystal

TABLE 20

| | Rate of Temperature Increase (° C./Minutes) | Hc (A/m) | Bs (T) | Pcm (W/kg) |
|---|---|---|---|---|
| Example 70 | 1200 | 14.6 | 1.86 | 0.62 |
| Example 71 | 600 | 11.9 | 1.91 | 0.63 |
| Example 72 | 400 | 14.1 | 1.90 | 0.64 |
| Example 73 | 300 | 12.4 | 1.89 | 0.61 |
| Example 74 | 100 | 18 | 1.92 | 0.81 |
| Comparative Example 30 | 60 | 64.5 | 1.93 | 1.09 |
| Comparative Example 31 | (Grain-Oriented Electrical Steel Sheet) | 23 | 2.01 | 1.39 |

As understood from Table 20, each of the Fe-based nano-crystalline alloys obtained by heat treating the alloy compositions of Examples 65-69 under temperature increase rate of 100° C. per minute or more has saturation magnetic flux density Bs of 1.65 T or more and coercivity Hc of 20 A/m or less. Furthermore, each of the Fe-based nano-crystalline alloys can be excited under the excitation condition of 1.7 T and has lower core loss than that of an electrical steel sheet.

Examples 75-78 and Comparative Examples 32, 33

Materials of Fe, Si, B, P and Cu were respectively weighed so as to provide alloy compositions of $Fe_{83.8}B_8Si_4P_4Cu_{0.7}$ and were melted by the high-frequency induction melting process to produce a master alloy. The master alloy was processed by the single-roll liquid quenching method so as to produce a continuous strip which has a thickness of about 25 μm, a width of 15 mm and a length of about 30 m. The continuous strip was exposed to a heat treatment process which was carried out in an Ar atmosphere under conditions of 300° C.×10 minutes. The heat-treated continuous strip was crushed to obtain powders of Example 75. The powders of Example 75 have diameters of 150 μm or smaller. In addition, the powders and epoxy resin were mixed so that the epoxy resin was of 4.5 weight %. The mixture was put through a sieve of 500 μm mesh so as to obtain granulated powders which had diameters of 500 μm or smaller. Then, by the use of a die that had an inner diameter of 8 mm and an outer diameter of 13 mm, the granulated powders were molded under a surface pressure condition of 7,000 kgf/cm$^2$ so as to produce a molded body that had a toroidal shape of 5 mm height. The thus-produced molded body was cured in a nitrogen atmosphere under a condition of 150° C.×2 hours. Furthermore, the molded body and the powders were exposed to heat treatment processes in an Ar atmosphere under a condition of 450° C.×10 minutes.

Materials of Fe, Si, B, P and Cu were respectively weighed so as to provide alloy compositions of $Fe_{83.8}B_8Si_4P_4Cu_{0.7}$ and were melted by the high-frequency induction melting process to produce a master alloy. The master alloy was processed by the water atomization method to obtain powders of Example 76. The powders of Example 76 had an average diameter of 20 μm. Furthermore, the powders of Example 76 were subjected to air classification to obtain powders of Examples 77 and 78. The powders of Example 77 had an average diameter of 10 μm, and the powders of Example 78 had an average diameter of 3 μm. The above-mentioned powders of each Example 76, 77, or 78 were mixed with epoxy resin so that the epoxy resin was of 4.5 weight %. The mixture thereof was put through a sieve of 500 μm mesh so as to obtain granulated powders which had diameters of 500 μm or smaller. Then, by the use of a die that had an inner diameter of 8 mm and an outer diameter of 13 mm, the granulated powders were molded under a surface pressure condition of 7,000 kgf/cm$^2$ so as to produce a molded body that had a toroidal shape of 5 mm height. The thus-produced molded body was cured in a nitrogen atmosphere under a condition of 150° C.×2 hours. Furthermore, the molded body and the powders were exposed to heat treatment processes in an Ar atmosphere under a condition of 450° C.×10 minutes.

Fe-based amorphous alloy and Fe—Si—Cr alloy were processed by the water atomization method to obtain powders of Comparative Examples 32 and 33, respectively. The powders of each of Comparative Examples 32 and 33 had an average diameter of 20 μm. Those powders were further processed, similar to Examples 75-78.

By using a differential scanning calorimetry (DSC), calorific values of the obtained powders upon their first crystallization peaks were measured and, then, were compared with that of the continuous strip of a single amorphous phase so that each amorphous rate, i.e. a rate of the amorphous phase in each alloy, was calculated. Also, saturation magnetic flux density Bs and coercivity Hc of each of the heat-treated powder alloys was measured by using a vibrating-sample magnetometer (VMS) under a magnetic field of 800 kA/m. Core loss of each molded body was measured by using an alternating current BH analyzer under excitation conditions of 300 kHz and 50 mT. The measurement results are shown in Table 21.

TABLE 21

| | Alloy Composition | Method | Average Diameter of Powder Particle (μm) | Amorphization Ratio for Pre-HTPP (%) | Bs of Post-HTPP (T) | Hc of Post-HTPP (A/m) | Average Diameter of Post-HTNC (nm) | Pcv of Post-HTM (mW/cc) |
|---|---|---|---|---|---|---|---|---|
| Example 75 | $Fe_{83.3}Si_4B_8P_4Cu_{0.7}$ | Single Roll + Crush | 32 | 100 | 1.86 | 28 | 17 | 1350 |
| Example 76 | | Water Atomization | 20 | 40 | 1.81 | 52 | 23 | 2000 |
| Example 77 | | Water Atomization | 10 | 65 | 1.84 | 48 | 19 | 1650 |
| Example 78 | | Water Atomization | 3 | 100 | 1.82 | 32 | 16 | 1240 |
| Comparative Example 32 | Fe-Based Amorphous | Water Atomization | 20 | — | 1.20 | 60 | — | 1900 |
| Comparative Example 33 | Fe—Si—Cr (Crystal) | Water Atomization | 20 | — | 1.68 | 96 | — | 2100 |

Pre-HTPP: Pre-Heat-Treatment Powder Particle; Post-HTPP: Post-Heat-Treatment Powder Particle; Post-HTNC: Post-Heat-Treatment Nano-Crystal; Post-HTM: Post-Heat-Treatment Molding As understood from Table 21, each of the alloy compositions of Examples 75-78 has nanocrystals posterior to the heat treatment processes, wherein the nanocrystals have an average diameter 25 nm or smaller for each of Examples 75-78. In addition, each of the alloy compositions of Examples 75-78 has high saturation magnetic flux density Bs and low coercivity Hc in comparison with Comparative Examples 32, 33. Each of dust cores formed by using the respective powders of Examples 75-78 also has high saturation magnetic flux density Bs and low coercivity Hc in comparison with Comparative Examples 32, 33. Therefore, the use thereof can provide a magnetic component or device which is small-sized and has high efficiency.

Each alloy composition may be partially crystallized prior to a heat treatment process provided that the alloy composition has, posterior to the heat treatment process, nanocrystals having an average diameter of 25 nm. However, as apparent from Examples 76-78, it is preferable that the amorphous rate is high in order to obtain low coercivity and low core loss.

The present application is based on a Japanese patent application of JP2008-214237 filed before the Japan Patent Office on Aug. 22, 2008, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An alloy composition consisting of the following formula: $Fe_aB_bSi_cP_xC_yCu_z$, wherein $81 \leqq a \leqq 86$ atomic %, $6 \leqq b \leqq 10$ atomic %, $2 \leqq c \leqq 8$ atomic %, $2 \leqq x \leqq 5$ atomic %, $0 \leqq y \leqq 4$ atomic %, $0.4 \leqq z \leqq 1.4$ atomic %, and $0.08 \leqq z/x \leqq 0.8$.

2. The alloy composition according to claim 1, wherein $0 \leqq y \leqq 3$ atomic %, $0.4 \leqq z \leqq 1.1$ atomic %, and $0.08 \leqq z/x \leqq 0.55$.

3. An alloy composition consisting of the following formula: $Fe_aB_bSi_cP_xC_yCu_zM_d$, wherein M is at least one element selected from the group consisting of Cr, Co, Ni, Al, Mn, Ag, Zn, Sn, As, Sb, Bi, Y, N, O and a rare-earth element, and d is 3 atomic % or less, and wherein $79 \leqq a \leqq 86$ atomic %, $5 \leqq b \leqq 13$ atomic %, $2 < c \leqq 8$ atomic %, $1 \leqq x \leqq 8$ atomic %, $0 < y \leqq 5$ atomic %, $0.4 \leqq z \leqq 1.4$ atomic %, and $0.08 \leqq z/x \leqq 0.8$.

4. The alloy composition according to claim 1, wherein the alloy composition has a continuous strip shape.

5. The alloy composition according to claim 1, wherein the alloy composition is formed in a powder form.

6. The alloy composition according to claim 1, wherein the alloy composition has a first crystallization start temperature ($T_{x1}$) and a second crystallization start temperature ($T_{x2}$) which have a difference ($\Delta T = T_{x2} - T_{x1}$) of 100° C. to 200° C.

7. A magnetic component formed from the alloy composition according to claim 1.

8. A method of forming an Fe-based nano-crystalline alloy, the method comprising:

subjecting the alloy composition according to claim 1 to a heat treatment under a condition that a temperature increase rate is 100° C. or more per minute and a condition that a process temperature is not lower than a crystallization start temperature of the alloy composition.

9. An Fe-based nano-crystalline alloy formed by the method according to claim 8, wherein the Fe-based nano-crystalline alloy has a magnetic permeability of 10,000 or more μ measured by using an impedance analyzer under conditions of 0.4 A/m and 1 kHz and a saturation magnetic flux density of 1.65 T or more.

10. The Fe-based nano-crystalline alloy according to claim 9, wherein the Fe-based nano-crystalline alloy has nano-crystals having an average diameter of 10 to 25 nm.

11. A magnetic component formed from the Fe-based nano-crystalline alloy according to claim 9.

12. The alloy composition according to claim 1, wherein an amorphous phase is obtained by a rapid cooling process.

13. The alloy composition according to claim 1, wherein the alloy composition has a saturation magnetic flux density of 1.77 T to 2.0 T.

14. The alloy composition according to claim 1, wherein the alloy composition has a nano-hetero structure which comprises initial microcrystals existing in an amorphous phase, wherein the microcrystals have an average diameter of 0.3 to 10 nm.

15. The alloy composition according to claim 4, the alloy composition being capable of being flat on itself when being subjected to a 180 degree bend test.

16. The Fe-based nano-crystalline alloy according to claim 9, wherein the Fe-based nano-crystalline alloy has a saturation magnetostriction of $10 \times 10^{-6}$ or less.

17. An alloy composition consisting of the following formula: $Fe_aB_bSi_cP_xC_yCu_z$, wherein $79 \leqq a \leqq 86$ atomic %, $5 \leqq b \leqq 13$ atomic %, $0 < c \leqq 8$ atomic %, $1 \leqq x \leqq 8$ atomic %, $0 < y \leqq 5$ atomic %, $0.4 \leqq z \leqq 1.4$ atomic %, and $0.08 \leqq z/x \leqq 0.8$.

* * * * *